US007614424B2

(12) United States Patent
Gloor

(10) Patent No.: US 7,614,424 B2
(45) Date of Patent: Nov. 10, 2009

(54) SANITARY FITTING WITH TELESCOPIC OUTLET SYSTEM

(75) Inventor: Herbert Gloor, Unterkulm (CH)

(73) Assignee: KWC AG, Unterkulm (CH)

( * ) Notice: Subject to any disclaimer, the term of this patent is extended or adjusted under 35 U.S.C. 154(b) by 393 days.

(21) Appl. No.: 11/372,271

(22) Filed: Mar. 10, 2006

(65) Prior Publication Data

US 2006/0201562 A1 Sep. 14, 2006

(30) Foreign Application Priority Data

Mar. 11, 2005 (EP) ..... 05005322

(51) Int. Cl.
*F16K 21/00* (2006.01)

(52) U.S. Cl. ..... 137/801; 285/302

(58) Field of Classification Search ..... 137/602, 137/603, 607, 801; 4/675–678; 285/145.4, 285/302

See application file for complete search history.

(56) References Cited

U.S. PATENT DOCUMENTS

| | | | | |
|---|---|---|---|---|
| 2,417,249 | A * | 3/1947 | Griswold | 244/111 |
| 3,680,780 | A | 8/1972 | Arbon | |
| 6,138,716 | A | 10/2000 | Yen | |
| 6,142,184 | A | 11/2000 | Yen | |
| 6,158,469 | A | 12/2000 | Yen | |
| 6,438,767 | B1 | 8/2002 | Warshawsky | |
| 2002/0053114 | A1 * | 5/2002 | Oh | 15/327.1 |

FOREIGN PATENT DOCUMENTS

| | | | |
|---|---|---|---|
| DE | 16 09 044 | A1 | 11/1971 |
| DE | 3820837 | A1 | 1/1990 |
| DE | 100 11 459 | A1 | 10/2001 |
| DE | 203 12 478 | U1 | 12/2003 |
| GB | 2 223 961 | A | 4/1990 |

* cited by examiner

*Primary Examiner*—John Rivell
*Assistant Examiner*—Craig M Schneider
(74) *Attorney, Agent, or Firm*—Oliff & Berridge, PLC

(57) ABSTRACT

The sanitary fitting (10) has an outflow conduit system (40) which can be telescoped by a displacement distance (H). The outflow conduit system (40) has an inner tube (42), which is retained by a base unit (39), and an outer tube (44), which can be moved longitudinally in relation to the inner tube (42). The inner tube (42) has a closed tube end (48) and, at a spacing from the closed tube end (48) which corresponds at least to the displacement distance (H), a radial through-passage (50). The radial through-passage (50) connects an interior of the inner tube (42) on a permanent basis to a lateral space (70) of constant volume, the lateral space being bounded by the inner tube (42) and the outer tube (44). Longitudinally running throughflow channels (78) run through the outer tube (44) to a free end region of the outer tube (44), in which water passes out of a water-outflow opening (90) when the control cartridge (18) is open.

19 Claims, 3 Drawing Sheets

10
10'
40
40'
39
39'
A
B
H
W
D
S
12
14
16
18
20
24
26
26'
28
30
42,43
44,45
46
48
50
52
60,60'
62
64
65
66,66'
68
70
78
80
82
84
86
88
90
93
94
96

10
40
39
18
16
112
110
20
116
118
26
24
28
84
93
48
120
66,66'
86
78
26'
S
A
B
50
65
44,43
60,60'
70
96
94
132
64
62
42,45
46
130
88
D
90
W
H 52
68

SANITARY FITTING WITH TELESCOPIC OUTLET SYSTEM

BACKGROUND

The present invention relates to a sanitary fitting.

Sanitary fittings for discharging water, in particular water mixed from cold water and hot water, are known in general. In order for it to be possible for the water flowing out to be directed onto different areas, it is known to provide sanitary fittings with telescopic or pull-out water outlets.

A sanitary fitting with a telescopic water outlet is disclosed, for example, in U.S. Pat. No. 6,138,716. The sanitary fitting described in this document has an inner tube which forms a throughflow tube and is retained by an outlet connector of a fitting housing. An outer tube is positioned on the inner tube, it being possible for the outer tube to be displaced in its longitudinal direction in relation to the inner tube. An outflow head is arranged at the free end of the outer tube. In order that hydraulic forces of the outflowing water do not result in unintentional displacement of the outer tube in relation to the inner tube, the inner tube has a plurality of circumferentially running recesses, in which an arresting means fastened on the outer tube can engage. The arresting means has to be released in order for the outer tube to be displaced in relation to the inner tube.

Furthermore U.S. Pat. No. 6,438,767 discloses a showering device with a vertically displaceable shower tube. This showering device has a vertically oriented inner tube which is fastened on a wall at both ends. The interior of the inner tube is connected to a water supply for the showering device. Furthermore, arranged centrally in the axial direction, the inner tube has a radial through-passage. A tubular sleeve, which butts in a sealing manner against the inner tube at both ends, is positioned on the inner tube and can be displaced in relation to the latter, a lateral space which is formed between the inner tube and the sleeve always being connected to the interior of the inner tube by the radial through-passage. A curved shower tube is fastened radially on the outside of the sleeve, the shower tube being connected to the lateral space at one end and bearing a shower head at the other end.

SUMMARY

The object of the present invention is to provide a sanitary fitting which manages without any arresting means acting between the inner tube and the outer tube.

According to the invention, the sanitary fitting has an outflow conduit system which can be telescoped by a displacement distance. The outflow conduit system has a throughflow tube, which is retained on the basic fitting body, and an outflow tube, which can be moved longitudinally in relation to the throughflow tube, one tube being an inner tube and the other being an outer tube. The inner tube has a closed tube end and, at a spacing from the closed tube end which corresponds at least to the displacement distance, a radial through-passage. The radial through-passage connects an interior of the inner tube on a permanent basis to a lateral space of constant volume, the lateral space being bounded by the inner tube and the outer tube. The telescopic displacement of the outer tube in relation to the inner tube is made possible by way of a cylindrical guide recess, in which the closed end of the inner tube is inserted in a displaceable manner, a sealing element preventing water from flowing through a gap which is formed between the inner tube and a wall of the outer tube which bounds the guide recess. It is consequently not possible for any water to flow out of the sanitary fitting from the lateral space through the guide recess.

An inner tube corresponding to the invention may also have, from the closed tube end, a longitudinally running hole, with the result that the inner tube has, between the radial through-passage and the closed tube end, a partition wall or a partition region which seals the inner tube between the radial through-passage and the closed tube end.

The sanitary fitting according to the invention having the telescopic outflow conduit system has a flow channel for water which contains the lateral space and has a constant volume when the telescopic outflow conduit system is extended or retracted. As a result—when the control cartridge arranged in the basic fitting body is closed—no water flows out of a water-outflow opening of the sanitary fitting when the system is retracted and, when the system is extended, no air, water or solid is taken into the outflow conduit system through the water-outflow opening.

According to a preferred embodiment, hydraulic forces in the longitudinal direction of the outflow conduit system largely compensate for one another in that hydraulic surfaces acting in both directions are at least more or less equal. A resultant hydraulic force acting in the longitudinal direction is compensated for by frictional forces acting between the throughflow tube and the outflow tube. This prevents the outflow tube from being displaced relative to the throughflow tube as water flows out of the sanitary fitting.

Further preferred embodiments of the sanitary fitting according to the invention are detailed below.

Further particular advantages and operations can be gathered from the detailed description and the drawing.

BRIEF DESCRIPTION OF THE DRAWINGS

The invention is explained in more detail hereinbelow with reference to a number of exemplary embodiments illustrated in the drawing, in which, purely schematically.

DETAILED DESCRIPTION OF EMBODIMENTS

Figures 1, 2:
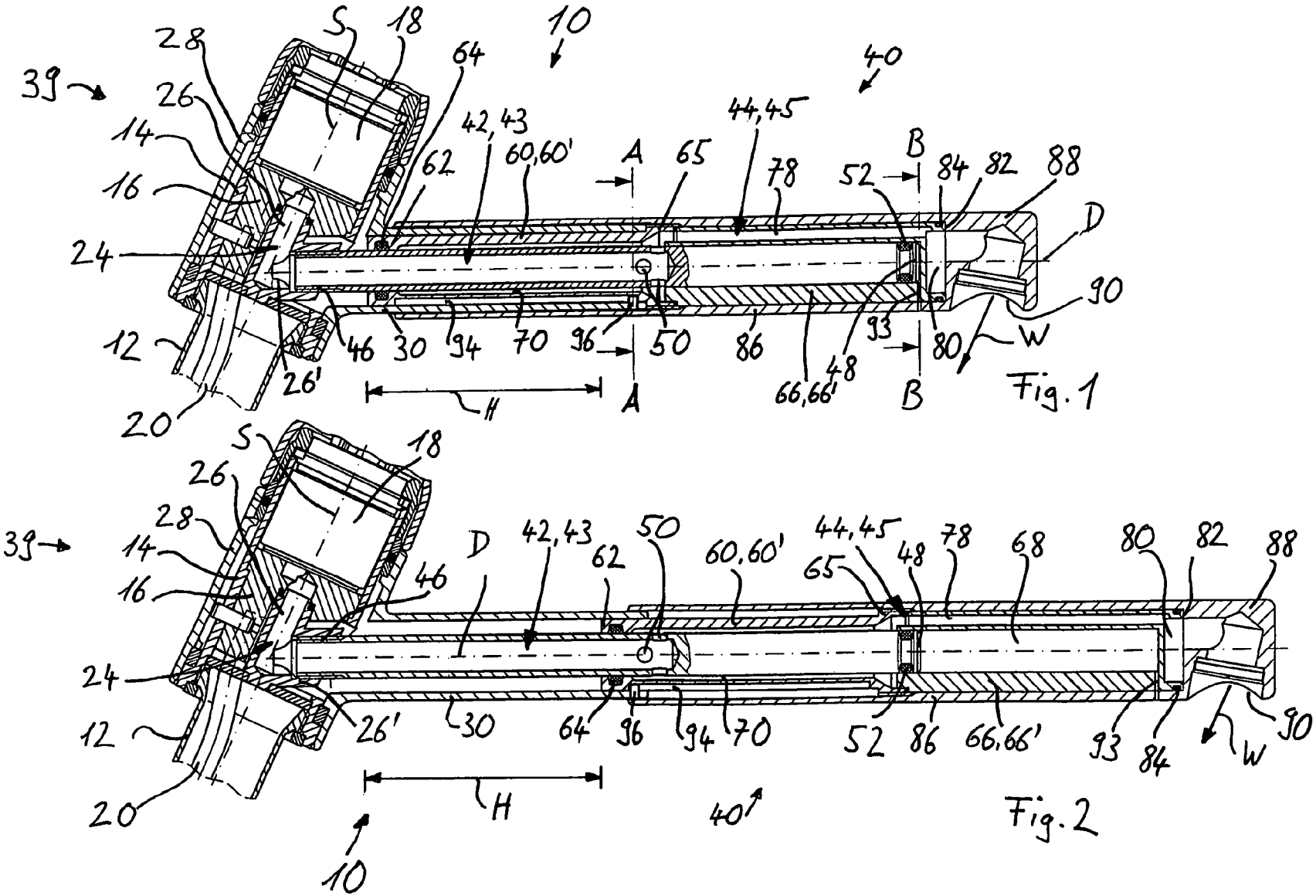
FIG. 1 shows a longitudinal section through a unit-top sanitary fitting according to the invention having a telescopic outflow conduit system comprising an inner tube and an outer tube, the inner tube being designed as a throughflow tube and the outer tube being designed as an outflow tube, and the outflow conduit system being retracted.
FIG. 2 shows a longitudinal section through the sanitary fitting according to the invention from FIG. 1, the outflow conduit system being extended.
Figures 3, 4:
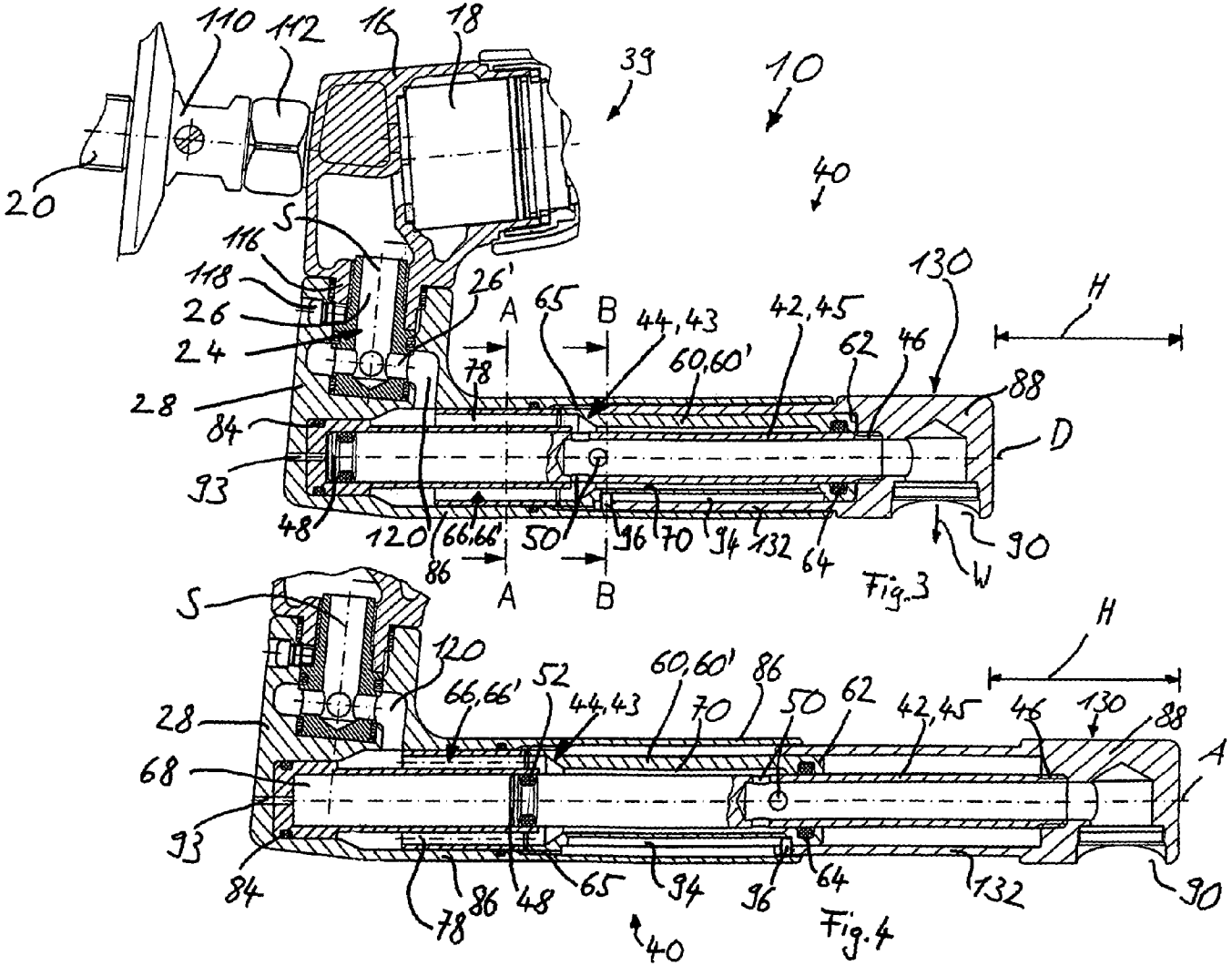
FIG. 3 shows a longitudinal section through a wall-mountable sanitary fitting according to the invention having a telescopic outflow conduit system comprising an inner tube and an outer tube, the outer tube being designed as a throughflow tube and the inner tube being designed as an outflow tube, and the outflow conduit system being retracted.
FIG. 4 shows a longitudinal section through the sanitary fitting according to the invention from FIG. 3, the outflow conduit system being extended.
Figure 5:
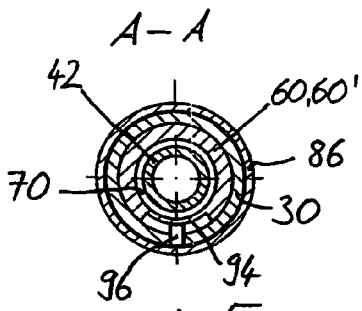
FIG. 5 shows a cross section through the outflow conduit system of FIG. 1 taken along line A-A.

A sanitary fitting 10 according to the invention shown in FIGS. 1, 2, 5 and 6 is designed for unit-top mounting. The sanitary fitting 10 has a downwardly projecting installation sleeve 12 which is intended for retaining the sanitary fitting 10 in a known manner on an installation surface for example a washbasin. Screwed onto the installation sleeve 12 is an inner sleeve 14 which contains, in its interior, a basic fitting body 16 and a control cartridge 18 positioned on the basic fitting body 16. The control cartridge 18 is connected to an actuating element, by means of which the flow of water through the sanitary fitting 10 and a mixing ratio of hot water and cold water can be regulated in a known manner.

On the supply side, the control cartridge 18 is connected to water supplies 20 for hot water and cold water, these being led through the installation sleeve 12 and through the basic fitting body 16 to the control cartridge 18. On the discharge side, the control cartridge 18 is connected to a mixed-water channel. The latter comprises an angled tube element 24 which can be rotated about a pivot axis S and has a supply-side tube leg 26 oriented in the direction of the pivot axis S and a discharge-side tube leg 26' defining an outflow-tube axis D. The pivot axis S is at right angles to the installation surface. The outflow-tube axis D is at an angle of, for example, 65 degrees to the pivot axis S, the outflow-tube axis D running upward away from the pivot axis S.

The inner sleeve 14 is encased by an outer fitting sleeve 28, which can be pivoted about the pivot axis S and can be pivoted in a known manner in a range of, for example, −30 degrees to +30 degrees in relation to a center position. A hollow-cylindrical outlet connector 30 projects from the outer fitting sleeve 28. A longitudinal axis of the outlet connector 30 is congruent with the outflow-tube axis D.

In order for an outflow conduit system 40 to be connected to the angled tube element 24, the inner sleeve 14 and the basic fitting body 16 have a through-opening or an aperture. The outflow conduit system 40 can be telescoped by a displacement distance H.

The installation sleeve 12, the inner sleeve 14, the basic fitting body 16, the angled tube element 24 and the outer fitting sleeve 28 with the outlet connector 30 together form a base unit 39.

For a detailed description of the installation sleeve 12, the inner sleeve 14, the basic fitting body 16, the control cartridge 18, the water supplies 20, the angled tube element 24 with the supply-side tube leg 26 and the discharge-side tube leg 26' and of the outer fitting sleeve 28 and further elements arranged on these elements, such as sealing rings and sliding rings, reference is expressly made to Applicant's earlier European Patent Application No. 05 001 644.3.

Outflow conduit system 40 which is fixed to the discharge-side tube leg 26' and retained by the outlet connector 30 comprises a rectilinear inner tube 42 of constant external diameter and an outer tube 44 which encases the inner tube 42. The outer tube 44 is designed as an outflow tube 45 and has, at its free end region, a water-outflow opening 90, out of which mixed water can flow in the water-outflow direction W. The inner tube 42 is designed as a throughflow tube 43 and is screwed into the discharge-side tube leg 26' by way of a threaded end connecting region 46. In the direction of the outflow-tube axis D, located opposite the end connecting region 46, the inner tube 42 has a closed tube end 48. At least at a spacing from this closed tube end 48 which corresponds to the displacement distance H, the inner tube 42 has radial through-passages 50, which are located opposite one another in pairs and are offset slightly in relation to one another in the direction of the outflow-tube axis D. The inner tube 42 is of solid design (without any cavity) between the radial through-passages 50 and the closed tube end 48. In the vicinity of the closed tube end 48, the inner tube 42 has an encircling groove, in which is placed an O-ring 52 acting as a sliding seal.

The outer tube 44 is formed in a number of pieces. Directed toward the basic fitting body 16 and arranged between the outlet connector 30 and the inner tube 42, the outer tube 44 has, in a lateral-space section 60, a lateral-space-section element 60'. At an end region of the lateral-space-section element 60' it is directed toward the basic fitting body 16, the outer tube 44 butts against the inner tube 42 in a sliding section 62. The sliding section 62 has an encircling groove, in which an O-ring 64 is placed, with the result that the sliding section 62 engages around the inner tube 42 in a sealing manner.

Except in an end region 65 which is located opposite the sliding section 62, as seen in the direction of the outflow-tube axis D, an external diameter of the lateral-space-section element 60' is more or less equal to a clear diameter of the outflow connector 30, with the result that the lateral-space-section element 60' can be displaced longitudinally in the outflow connector 30. The end region 65 has an external thread which has an external diameter which is greater than an internal diameter, but smaller than an external diameter, of the outflow connector 30. Directed toward the sliding section 62, the end region 65 has a stop surface which—in the state in which the outer tube 44 has been pushed in onto the inner tube 42—rests at least more or less against an end surface of the outflow connector 30 (FIG. 1).

Opposite to the sliding section 62, as seen in the direction of the outflow-tube axis D, the lateral-space section 60 is adjoined by a guide section 66. A cylindrical guide-section element 66' located in the guide section 66 has a cylindrical guide recess 68, of which the clear cross section corresponds more or less to an outer cross section of the inner tube 42. The guide recess 68 is closed at an end which is located opposite the lateral-space section 60. The guide recess 68 has a length which is somewhat longer than the displacement distance H.

The inner tube 42 engages in the guide recess 68, the O-ring 52 interacting with the wall of the guide recess 68 in order to prevent water from flowing through the gap between the inner tube 42 and the wall of the guide recess 68. This likewise prevents water from being able to flow out of the sanitary fitting 10 from the lateral space 70 through the guide recess 68.

Instead of the sealing-element-forming O-ring 52 being arranged in the groove at the closed end 48 of the inner tube 42, it is possible for the O-ring to be placed in an encircling groove in the wall of the guide recess 68, in the vicinity of the lateral space 70.

Except in the sliding section 62, an inner lateral surface of the lateral-space-section element 60' is spaced apart from the inner tube 42, with the result that a lateral space 70 is located radially between an outer surface of the inner tube 42 and an inner surface of the outer tube 44 which is located in the lateral-space section 60, and in the longitudinal direction between the sliding section 62 and the guide section 66.

Figure 6:
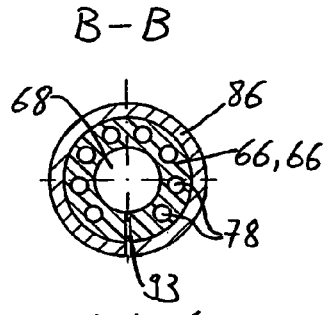
FIG. 6 shows a cross section through the outflow conduit system of FIG. 1 taken along line B-B.
Figure 7:
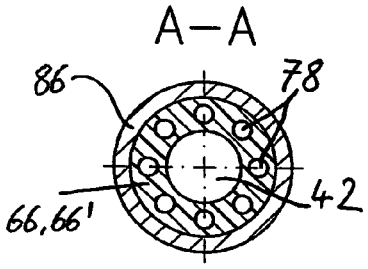
FIG. 7 shows a cross section through the outflow conduit system of FIG. 3 taken along line A-A.
Figure 8:
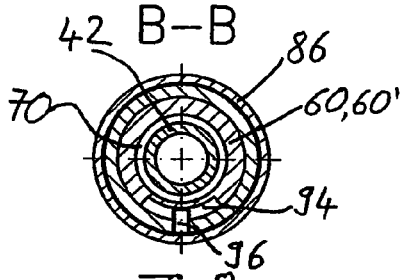
FIG. 8 shows a cross section through the outflow conduit system of FIG. 3 taken along line B-B.

FIG. 6 shows eight throughflow channels 78 that are led through the guide-section element 66' parallel to the outflow-tube axis D, it also being possible, of course, for more or fewer than eight throughflow channels 78 to be led through the guide-section element 66'. The throughflow channels 78 are arranged in a regular manner in a circumferential direction, there being no throughflow channel arranged in a bottom section located in the water-outflow direction W. The throughflow channels 78 connect the lateral space 70 to a combined-flow space 80, which is located in an end region of the guide-section element 66' which is located opposite the lateral-space section 60.

In the vicinity of an end surface 82 on this side, the guide-section element 66' has an outer encircling groove in which an O-ring 84 is placed. The guide-section element 66' is encased by an outer-tube outer sleeve 86 which has a constant external diameter and a discharge section 88.

The discharge section 88 is adjacent to the guide section 66 and has a stop surface interacting with the end surface 82 of the guide-section element 66'. The discharge section 88 also has the water-outflow opening 90, out of which water flows—if the control cartridge 18 is open—in the water-outflow direction W.

Furthermore, the outer-tube outer sleeve 86 has an internal thread which interacts with the external thread of the lateral-space-section element 60', with the result that the guide-section element 66' is retained in a fixed manner between the discharge section 88 and the lateral-space-section element 60'. A seal is inserted between the guide-section element 66' and the lateral-space-section element 60'.

The length of the outer-tube outer sleeve 86 is selected such that the latter, in the extended state of the outflow conduit system 40, encloses the lateral-space-section element 60' and encases an end region adjoining the free end of the outlet connector 30. At an end which is located opposite the discharge section 88 in the direction of the outflow-tube axis D, the outer-tube outer sleeve 86 has a stripper, which prevents liquids, for example water and cleaning agents, and solids, in particular dirt, from being able to penetrate into the thin gap between the outer-tube outer sleeve 86 and the outlet connector 30.

In order that no negative pressure or positive pressure is produced in the guide recess 68 when the outflow conduit system 40 is retracted or extended, this guide recess is connected to the surroundings via a venting channel 93. The venting channel leads, in the vicinity of the closed end, through the guide-section element 66' and through the outer-tube outer sleeve 86.

In order to limit the displacement distance H of the outflow conduit system, the lateral-space-section element 60' has a limiting recess 94, in which a stop pin 96 which is fixed to the outlet connector 30 engages. The length of the limiting recess 94 corresponds to the displacement distance H plus the diameter of the stop pin 96. A width of the limiting recess is selected such that the outer tube 44 can be pivoted in relation to the inner tube 42, about the outflow-tube axis D, from, for example, −30 degrees to +30 degrees (FIG. 5), the water-outflow direction W running parallel to the pivot axis S in a position of 0 degrees. The limiting recess 94 is formed such that, in each position of the outer tube 44 in relation to the inner tube 42, the radial through-passages 50 connect the interior of the inner tube 42 to the lateral space 70.

The material used for the lateral-space-section element 60', the outlet connector 30, the inner tube 42 and the outer-tube outer sleeve 86 is preferably a metal, it also being possible to use a plastic, preferably polyacetal (POM). The guide-section element 66' is preferably produced from polyacetal (POM).

The outflow conduit system 40 is assembled as follows. The inner tube 42 is screwed into the discharge-side tube leg 26' of the angled tube element 24. The lateral-space-section element 60' is positioned on the inner tube 42 and the stop pin 96 is then inserted into the outlet connector 30, with the result that the stop pin 96 engages in the limiting recess 94. The guide-section element 66' is introduced into the outer-tube outer sleeve 86 and possibly adhesively bonded therein. In a following step, the outflow-tube outer sleeve 86 with the guide-section element 66' contained therein is screwed onto the lateral-space-section element 60'.

In another embodiment of the outflow conduit system 40 according to the invention, the venting channel is guided such that it opens out into the surroundings concealed by another element of the sanitary fitting, for example within the installation sleeve 12.

FIGS. 3, 4, 7 and 8 show a second exemplary embodiment of a sanitary fitting 10 according to the invention, this embodiment being designed for wall mounting. A water supply 20 is led through a wall to a wall connection 110. The wall connection 110 has a fastening nut 112 which retains a basic fitting body 16 in a fixed manner on the wall connection 110. The water supply 20 is led, through the wall connection 110 and through the basic fitting body 16, to a control cartridge 18 inserted into the basic fitting body 16. For a detailed description of said elements and of further elements, reference is made to the earlier European Patent Application No. 05 001 644.3.

The basic fitting body 16 has a cylindrical connector 116 which is oriented in the direction of a vertical pivot axis S and projects downward out of the basic fitting body 16. A cylindrical angled tube element 24 is screwed into the connector 116.

Plugged onto the angled tube element 24 and onto the connector 116 is the outer fitting sleeve 28, which is retained in a pivotable manner on the connector 116 and on the angled tube element 24 by means of a stop screw 118 engaging in a guide recess on the connector 116.

In order to prevent liquids and dirt from penetrating, a sealing ring is arranged between the connector 116 and the outer fitting sleeve 28, adjacent to an opening of the outer fitting sleeve 28. In order to allow the outer fitting sleeve 28 to rotate about the pivot axis S, a first sliding disk is arranged adjacent to the sealing ring between the connector 116 and the outer fitting sleeve 28. A second sliding disk is arranged between the outer fitting sleeve 28 and an end region of the angled tube element 24 which is directed away from the basic fitting body 16.

Beneath the stop screw 118, a sealing ring is arranged between the outer fitting sleeve 28 and the angled tube element 24. Alongside, beneath the sealing ring, the outer fitting sleeve 28 has a chamber 120 which is connected to the supply-side tube leg 26 via the discharge-side tube leg 26' of the angled tube element 24. The supply-side tube leg 26 is connected to a discharge-side opening of the control cartridge 18 via a mixed-water channel.

Beneath the angled tube element 24, an outer-tube outer sleeve 86 projects from the outer fitting sleeve 28 in the direction of an outflow-tube axis D, the outer-tube outer sleeve being produced integrally with the outer fitting sleeve 28. This is intended to retain the outflow conduit system 40.

The basic fitting body 16, together with the angled tube element 24, the outer fitting sleeve 28 and the outer-tube outer sleeve 86, forms the base unit 39.

An inner tube 42 and an outer tube 44 are designed in essentially the same way as the inner tube and the outer tube of the first exemplary embodiment, but are arranged the other way round. Only the differences will be discussed hereinbelow. In this exemplary embodiment, in contrast to the first exemplary embodiment, the outer tube 44 forms a throughflow tube 43 and the inner tube 42, which is designed in a largely identical manner to the inner tube of the first exemplary embodiment, forms the outflow tube 45.

The outer tube 44 has, in one end region, the guide-section element 66', which forms the guide section 66. The guide-section element 66' is in the form of a radially stepped cylinder on the outside and has a guide recess 68 on the inside, the clear cross section of this recess corresponding to the outer cross section of the inner tube 42. Apart from a venting channel 93 running in the direction of the outflow-tube axis D, the guide recess 68 is closed at its base. The guide recess 68 is intended to accommodate the closed end 48 of the inner tube 42, which is designed in an identical manner to the inner tube of the first exemplary embodiment. Once again, a sealing-element-forming O-ring 52, which is arranged on the inner tube, prevents water from flowing through the gap formed between the inner tube 42 and the wall of the guide recess 68.

A region of the guide-section element 66' adjacent to an end surface of the guide-section element 66' which has the venting channel 93 is a supply and retaining region. The supply and retaining region has a smaller external diameter than the rest of the guide-section element 66'. At a little distance from this end of the supply and retaining region, the guide-section element 66' has an encircling groove, in which an O-ring 84 is placed.

The supply and retaining region of the guide-section element 66' is inserted into a recess of the outer fitting sleeve 28, which encloses the end region with the O-ring 84 in a sealed manner. Adjacent to the region which engages around the guide-section element 66' in a sealed manner, the recess in the outer fitting sleeve 28 widens conically to a diameter which corresponds more or less to the largest external diameter of the guide-section element 66'. The recess is connected to the chamber 120.

Around the guide recess 68, eight throughflow channels 78 run through the guide-section element 66' in the direction of the outflow-tube axis D and open out into a lateral space 70 of a lateral-space-section element 60' located in the lateral-space section 60 of the outer tube 44. Of course, it is also possible for more or fewer than eight throughflow channels 78 to lead through the guide-section element 66'. The lateral-space-section element 60' is designed in an identical manner to the lateral-space-section element of the first exemplary embodiment. The lateral-space-section element 60' is screwed, by way of its externally threaded end region 65, into an internal thread of the outflow-tube outer sleeve 86, as a result of which the guide-section element 66' is likewise retained in a fixed manner. In order to ensure a sealed transition from the guide-section element 66' to the lateral-space-section element 60', a sealing ring is arranged between these two elements. The outflow-tube outer sleeve 86 has an encircling groove which is spaced apart from the internal thread and in which is placed an O-ring which butts against the guide-section element 66'.

The length of the outer-tube outer sleeve 86 is selected such that the sliding section 62 projects out of the same. Except in the end region 65, the lateral-space-section element 60' is spaced apart from the outer-tube outer sleeve 86.

In comparison with the inner tube of the first exemplary embodiment, the inner tube 42 has, in addition, an outlet element 130 screwed onto the connecting region 46. The outlet sleeve 132, which encases the inner tube 42 and is spaced apart from the inner tube 42, projects from the outlet element 130. The outlet sleeve 132 engages in a hollow-cylindrical gap between the lateral-space-section element 60' and the outer-tube outer sleeve 86. The length of the outlet sleeve 132 is selected such that, in the extended state of the outflow conduit system 40, it engages around the sliding section 62 of the lateral-space-section element 60' and, in the retracted state of the outflow conduit system 40, it strikes more or less against the end surface of the end region 65 of the lateral-space-section element 60'.

Arranged inside the free end of the outer-tube outer sleeve 86 is a stripper ring, which prevents liquids and other substances from being able to penetrate into the thin gap between the outer-tube outer sleeve 86 and the outlet sleeve 132.

The outlet element 130 has a water-outlet opening 90, which is connected to the interior of the inner tube 42 and out of which water runs in the water-outflow direction W.

A stop pin 96, which is inserted into an exposed end region of the outlet sleeve 132, engages in the limiting recess 94, this limiting the displacement distance H along the outflow-tube axis D and the rotatability of the outflow tube 45 in a manner analogous to the first exemplary embodiment.

The outflow conduit system 40 is assembled as follows. The guide-section element 66' is inserted through an opening of the outer-tube outer sleeve 86 into the outer fitting sleeve 28 and into the outer-tube outer sleeve 86. The inner tube 42 is screwed, by way of the end connecting region 46, into the outlet element 130, and the guide-section element 66' is positioned on the inner tube 42 with the sliding section 62 in front. In a following step, the stop pin 96 is inserted into the limiting recess 94 of the guide-section element 66'. The guide-section element 66' is inserted into the outer-tube outer sleeve 86, together with the inner tube 42, and screw-connected.

Figure 9:
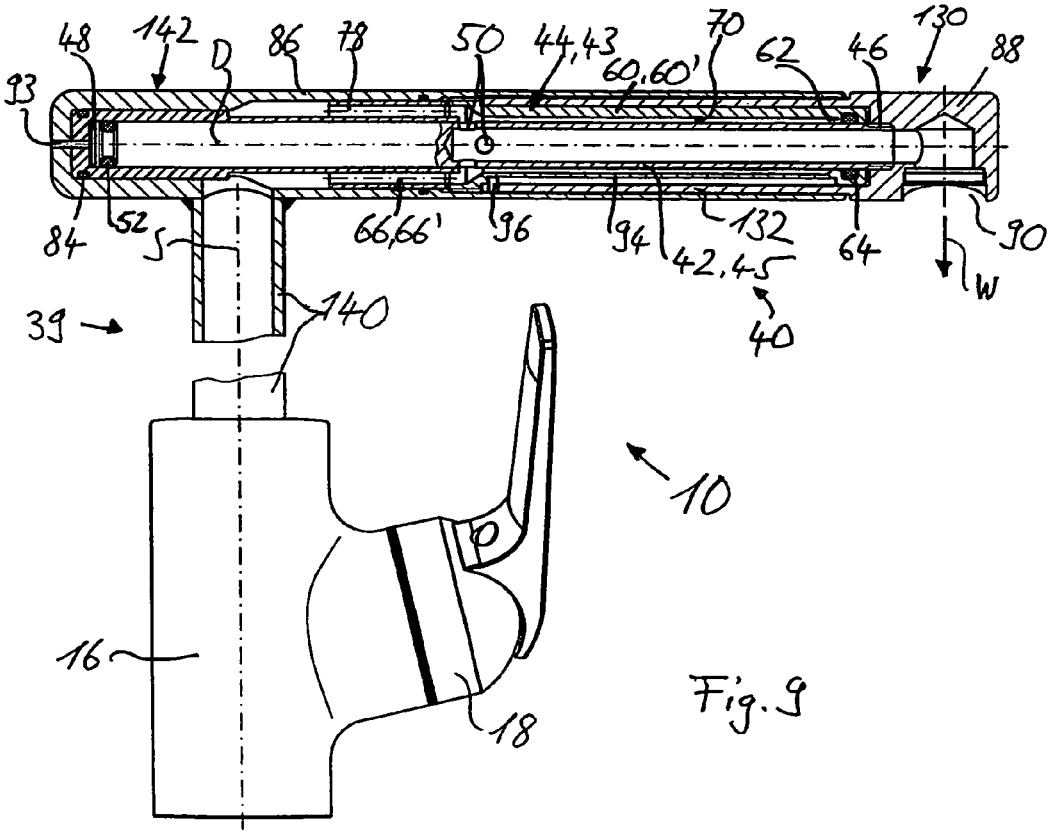
FIG. 9 shows a longitudinal section through a unit-top sanitary fitting according to the invention having a telescopic outflow conduit system comprising an inner tube and an outer tube, the outer tube being designed as a throughflow tube and the inner tube being designed as an outflow tube, and the outflow conduit system being retracted.

FIG. 9 shows a third exemplary embodiment of a sanitary fitting according to the invention, and only differences between this and the second embodiment will be discussed here. The sanitary fitting 10 has a cylindrical basic fitting body 16 oriented in the direction of a pivot axis S. A control cartridge 18 is inserted into this basic fitting body 16 in a known manner. A connecting tube 140, which can be rotated about the pivot axis S, leads upwards away from the basic fitting body 16 in the direction of the pivot axis S, the outflow conduit system 40 being fitted at the end of this connecting tube. The outflow-tube axis D runs at least more or less at right angles to the pivot axis and horizontally. The basic fitting body 16, together with the connecting tube 140, forms a base unit 39.

The outflow conduit system 40 is designed in a manner identical to the outflow conduit system of the second exemplary embodiment, apart from the end region 142 of the outer-tube outer sleeve 86, this end region butting against the guide-section element 66'. The end region 142 is cylindrical on the outside. At a distance from a free end of the end region 142, the latter is connected to the connecting tube 140, which opens out into the supply and retaining region, in a manner corresponding to the channel of the second exemplary embodiment.

What is claimed is:

1. A sanitary fitting having a base unit and a telescopic outflow conduit system, the telescopic outflow conduit system comprising:

an inner tube; and an outer tube, which can be displaced telescopically relative to the inner tube by a displacement distance, one of these tubes being a throughflow tube which is retained on the base unit and the other being an outflow tube with a water-outflow opening arranged at an end which is directed away from the base unit, wherein the throughflow tube is in fluid communication with a sanitary water supply to receive water therethrough, the inner tube having a closed tube end at one end, and the inner tube having at a spacing from the closed tube end which corresponds at least to the displacement distance, a radial through-passage which connects the interior of the inner tube on a permanent basis to a lateral space, which is bounded by the inner tube and outer tube and has a constant volume, the outer tube having a cylindrical guide recess in which the closed tube end of the inner tube is arranged in a displaceable manner, and a sliding seal fixedly arranged on the inner tube at the closed tube end at a fixed distance from the radial through-passage, the sliding seal allowing relative movement of the cylindrical guide recess and preventing water from flowing through between the wall of the guide recess and the inner tube.

2. The sanitary fitting as claimed in claim 1, wherein hydraulic forces which act on the outflow tube in the longitudinal direction largely compensate for one another, and a frictional force acts between the outflow tube and the throughflow tube.

3. The sanitary fitting as claimed in claim 1, wherein the outer tube has a lateral-space section, which bounds the lateral space, and a guide section, which is adjacent to the lateral-space section in the longitudinal direction, the guide section has, in an axially arranged manner, the guide recess for the inner tube, the clear cross section of the guide recess corresponding at least more or less to an outer cross section of the inner tube, and the lateral-space section, which is located opposite the guide section in the longitudinal direction, has a sliding section which interacts with the inner tube in a sealing manner.

4. The sanitary fitting as claimed in claim 3, wherein the guide recess of the guide section is connected to the surroundings by means of a venting channel.

5. The sanitary fitting as claimed in claim 1, wherein a stop pin, which is stationary in relation to the inner tube, engages in a limiting recess of the outer tube, the stop pin, interacting with the limiting recess, limiting the displacement distance and limiting or precluding rotation of the outer tube about the inner tube.

6. The sanitary fitting as claimed in claim 3, wherein the inner tube is the throughflow tube, the lateral-space section of the outer tube is directed toward the base unit, the outer tube, following the guide section in the longitudinal direction, has a discharge section with the water-outlet opening, and the lateral space is connected to the water-outflow opening via a throughflow channel in the guide section.

7. The sanitary fitting as claimed in claim 3, wherein the outer tube is the throughflow tube, the guide section of the outer tube is directed toward the base unit, and the inner tube, following an opening of the inner tube which is located opposite the closed tube end, as seen in the longitudinal direction, has a discharge section with the water-outflow opening.

8. The sanitary fitting as claimed in claim 1, wherein the throughflow tube is mounted in a pivotable manner on the base unit.

9. The sanitary fitting as claimed in claim 2, wherein the outer tube has a lateral-space section, which bounds the lateral space, and a guide section, which is adjacent to the lateral-space section in the longitudinal direction, the guide section has, in an axially arranged manner, the guide recess for the inner tube, the clear cross section of the guide recess corresponding at least more or less to an outer cross section of the inner tube, and the lateral-space section, which is located opposite the guide section in the longitudinal direction, has a sliding section which interacts with the inner tube in a sealing manner.

10. The sanitary fitting as claimed in claim 9, wherein the guide recess of the guide section is connected to the surroundings by means of a venting channel.

11. The sanitary fitting as claimed in claim 2, wherein a stop pin, which is stationary in relation to the inner tube, engages in a limiting recess of the outer tube, the stop pin, interacting with the limiting recess, limiting the displacement distance and limiting or precluding rotation of the outer tube about the inner tube.

12. The sanitary fitting as claimed in claim 9, wherein the inner tube is the throughflow tube, the lateral-space section of the outer tube is directed toward the base unit, the outer tube, following the guide section in the longitudinal direction, has a discharge section with the water-outlet opening, and the lateral space is connected to the water-outflow opening via a throughflow channel in the guide section.

13. The sanitary fitting as claimed in claim 9, wherein the outer tube is the throughflow tube, the guide section of the outer tube is directed toward the base unit, and the inner tube, following an opening of the inner tube which is located opposite the closed tube end, as seen in the longitudinal direction, has a discharge section with the water-outflow opening.

14. The sanitary fitting as claimed in claim 2, wherein the throughflow tube is mounted in a pivotable manner on the base unit.

15. The sanitary fitting as claimed in claim 3, wherein the throughflow tube is mounted in a pivotable manner on the base unit.

16. The sanitary fitting as claimed in claim 4, wherein the throughflow tube is mounted in a pivotable manner on the base unit.

17. The sanitary fitting as claimed in claim 5, wherein the throughflow tube is mounted in a pivotable manner on the base unit.

18. The sanitary fitting as claimed in claim 6, wherein the throughflow tube is mounted in a pivotable manner on the base unit.

19. The sanitary fitting as claimed in claim 7, wherein the throughflow tube is mounted in a pivotable manner on the base unit.

* * * * *